US006780554B2

(12) United States Patent
Tong et al.

(10) Patent No.: US 6,780,554 B2
(45) Date of Patent: Aug. 24, 2004

(54) IMAGING MEMBER

(75) Inventors: Yuhua Tong, Webster, NY (US); Timothy J. Fuller, Pittsford, NY (US); Colleen A. Helbig, Penfield, NY (US); Kent J. Evans, Lima, NY (US); John F. Yanus, Webster, NY (US); Karen S. Garland, Palmyra, NY (US); Paul J. DeFeo, Sodus Point, NY (US); Anita P. Lynch, Webster, NY (US); Kathleen M. Carmichael, Williamson, NY (US); Damodar M. Pai, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/320,856

(22) Filed: Dec. 16, 2002

(65) Prior Publication Data

US 2004/0115547 A1 Jun. 17, 2004

(51) Int. Cl.[7] ..... G03G 5/047

(52) U.S. Cl. ..... 430/58.8; 430/970; 430/59.4; 430/59.6; 430/64; 430/65; 430/133; 430/58.05

(58) Field of Search ..... 430/58.8, 59.4, 430/65, 59.6, 970, 64, 133, 58.05

(56) References Cited

U.S. PATENT DOCUMENTS

| | | | | |
|---|---|---|---|---|
| 4,233,384 A | | 11/1980 | Turner et al. | 430/59 |
| 4,265,990 A | | 5/1981 | Stolka et al. | 430/59 |
| 4,286,033 A | | 8/1981 | Neyhart et al. | 430/58 |
| 4,291,110 A | | 9/1981 | Lee | 430/59 |
| 4,299,897 A | | 11/1981 | Stolka et al. | 430/59 |
| 4,306,008 A | | 12/1981 | Pai et al. | 430/59 |
| 4,338,387 A | | 7/1982 | Hewitt | 430/58 |
| 4,439,507 A | | 3/1984 | Pan et al. | 430/59 |
| 4,654,284 A | | 3/1987 | Yu et al. | 430/59 |
| 4,988,597 A | | 1/1991 | Spiewak et al. | 430/62 |
| 5,244,762 A | | 9/1993 | Spiewak et al. | 430/64 |
| 5,334,478 A | * | 8/1994 | Desilets et al. | 430/135 |
| 5,407,766 A | * | 4/1995 | Mayo et al. | 430/59.4 |
| 6,261,729 B1 | * | 7/2001 | Yuh et al. | 430/65 |
| 2002/0076631 A1 | * | 6/2002 | Itami et al. | 430/58.2 |

OTHER PUBLICATIONS

Borsenberger, Paul et al. Organic Photoreceptors for Imaging Systems. New York: Marcel–Dekker, Inc. (1993) pp. 6–9, 289–292.*

* cited by examiner

*Primary Examiner*—Christopher RoDee
(74) *Attorney, Agent, or Firm*—Oliff & Berridge, PLC; Eugene Palazzoo

(57) ABSTRACT

A charge transport layer for an imaging member comprising a photogenerating layer, (1) a first charge transport layer comprised of a charge transport component and a resin binder, and thereover and in contact with the first layer (2) a second top charge transport layer comprised of a charge transport component, and a polymer of a styrene containing hindered phenol.

The charge transport layer exhibits excellent wear resistance, excellent electrical performance, and outstanding print quality.

31 Claims, No Drawings

IMAGING MEMBER

CROSS-REFERENCE TO RELATED APPLICATIONS

Attention is directed to commonly-assigned copending U.S. patent application Ser. No. 10/320,808, D/A1618, filed Dec. 16, 2002, by Horgan, et al, and which application discloses an imaging member comprised of a photogenerating layer, (1) a first charge transport layer comprised of a charge transport component and a resin binder, and thereover and in contact with the first layer (2) a second top charge transport layer comprised of a charge transport component, a resin binder and a hindered phenol dopant.

The disclosures of the above mentioned copending applications are totally incorporated herein by reference.

BACKGROUND

This invention relates in general to layered imaging members comprised for example, of a photogenerating layer; (1) a first charge transport layer comprised for example, of a charge transport component and a resin binder, and thereover and in contact with the first layer; (2) a second top charge transport layer comprised for example, of a charge transport component, and a polymer of a styrene containing hindered phenol. Advantages associated with the imaging members of the present invention, in embodiments, thereof include for example, the avoidance of or minimal undesirable migration of a hindered phenol to the photogenerating layer to thereby avoid imaging member instability, such as, electrical performance degradation, and undesirable electrical characteristics especially on long term cycling of the member; coating of two transport layers in separate passes to for example, minimize the transport layers thickness variations which variations can cause image defects referred to as rain drops; minimizing and in embodiments, avoiding an increase in the lateral surface conductivity of the member which in turn can cause image degradation, referred to as lateral conductivity migration (LCM) and which disadvantages are minimized by adding to the second transport layer a polymer of styrene having attached thereto a hindered phenol moiety or moieties.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this invention are useful in color xerographic applications, particularly high-speed color copying and printing processes and which members are in embodiments, sensitive in the wavelength region of, for example, from about 500 to about 900 nanometers, and in particular from about 650 to about 850 nanometers, thus diode lasers can be selected as the light source.

REFERENCES

Electrophotographic imaging members may be multilayered photoreceptors that comprise a substrate support, an electrically conductive layer, an optional charge blocking layer, an optional adhesive layer, a charge generating layer, a charge transport layer, and an optional protective or overcoating layers. The imaging members can be of several forms, including flexible belts, rigid drums, and the like. For a number of multilayered flexible photoreceptor belts, an anticurl layer may be employed on the backside of the substrate support, opposite to the side carrying the electrically active layers.

Various combinations of materials for the charge generating layers and charge transport layers have been disclosed. U.S. Pat. No. 4,265,990, the disclosure of which is totally incorporated herein by reference, illustrates a layered photoreceptor having a separate charge generating layer (CGL) and a separate charge transport layer (CTL). The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,265,990, 4,233,384, 4,306,008, 4,299,897 and 4,439,507, the disclosures of each of these patents being totally incorporated herein by reference in their entirety.

In multilayer photoreceptor devices, one property, for example, is the charge carrier mobility in the transport layer. Charge carrier mobility determines the velocities at which the photo-injected carriers transit the transport layer. For greater charge carrier mobility capabilities, for example, it may be necessary to increase the concentration of the active molecule transport compounds dissolved or molecularly dispersed in the binder. Phase separation or crystallization can establish an upper limit to the concentration of the transport molecules that can be dispersed in a binder. Thus there is desired an imaging member that exhibits excellent performance properties and minimizes lateral conductivity migration of the charge image pattern and which characteristics may be achievable by including in the member, especially the top charge transport layer a styrene polymer containing and attached thereto a hindered phenol and wherein the hindered phenol is present for example, in an amount of from about 2 weight percent to about 10 weight percent. In specific embodiments, the hindered phenol is present in an amount of from about 5 to about 8 percent by weight.

SUMMARY

Aspects of the present invention, relate to an electrophotographic imaging member comprising a photogenerating layer, (1) a first charge transport layer comprised of a charge transport component and a resin binder, and thereover and in contact with the first charge transport layer (2) a second top charge transport layer comprised of a charge transport component, a binder resin or polymer and a polymer of a styrene having attached thereto a hindered phenol, and wherein the migration of the hindered phenol to the first charge transport layer is avoided; methods of imaging as illustrated herein and imaging devices thereof.

The first charge transport layer includes at least one charge transport material, of for example, in embodiments, a charge, especially hole transport component and a polymer binder, and which layer can be deposited on a second charge transport layer containing a charge transport component, a resin binder and a polymer of a styrene containing a hindered phenol. In embodiments, the hindered phenol can be selected from the group consisting of octadecyl 3,5-di-tert-butyl-4-hydroxyhydrocinnamate, Thiodiethylene bis-(3,5-di-tert-butyl-4-hydroxy)hydrocinnamate, o,o-di-n-octadecyl-3,5-di-tert-butyl-4-hydroxybenzyl phosphonate, N,N'-hexamethylene bis-(3,5-di-tert-butyl-4-hydroxy-hydrocinnamamide), 1,3,5-tris(3,5-di-tert-butyl-4-hydroxybenzyl)-1,3,5-triazine-2,4,6(1H,3H,5H)-trione.

In embodiments the second top charge transport layer comprises a charge transport component and a polymer of styrene containing hindered phenol, where the polymer of styrene is represented by:

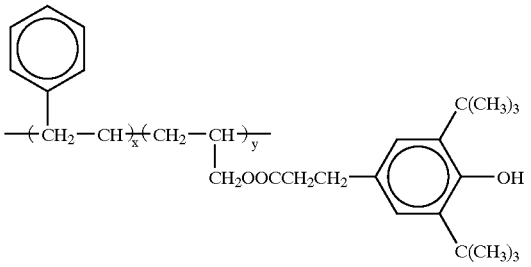

wherein x and y represent the number of segments.

In embodiments, the hindered phenol is present for example, in the styrene polymer in an amount of from about 0.05 to about 0.5 mole percent. In a more specific embodiment, the hindered phenol is present in the styrene polymer in an amount of from about 0.15 to about 0.3 mole percent. The hindered phenol is incorporated into the styrene polymer during esterification by a covalent bond connection. The resulting polymer in embodiments, has for example, a weight average molecular weight of from about 1,000 to 20,000, and a number average molecular weight of from about 1,500 to about 18,000. In a more specific embodiment, the resulting polymer has a weight average molecular weight of from about 3,500 to 15,000, and a number average molecular weight of from about 3,000 to about 10,000.

In specific embodiments, the hindered phenol comprises octadecyl-3,5-di-tert-butyl-4-hydroxyhydrociannamate, available as IRGANOX® from Ciba Specialty Chemicals.

For the application of each of the charge transport layers there can be selected a number of known suitable organic solvents such as, methylene chloride, toluene and tetrahydrofuran and wherein the total solid, that is charge transport and binder amount ratio to total solvent amount is for example, from about 10:90 weight percent to about 30:70 weight percent, and in embodiments, from about 15:85 weight percent to about 25:75 weight percent.

The dual or two separate charge transport layers can be deposited in two passes, wherein for the first pass the first charge transport layer is coated on the photogenerating layer and wherein during the second pass the second charge transport layer is coated on the first charge transport layer and the charge transport compounds are substantially soluble in the styrene/hindered phenol polymer and also wherein the styrene/hindered phenol polymer can replace a portion of the resin binder in the second pass, such as a polycarbonate binder. The first layer can comprise suitable charge transport compounds, such as, an aryl amine, like N,N'-diphenyl-N,N'-bis(3-methylphenyl)-[1,1'-biphenyl]-4,4'diamine and a polymer binder; and the second charge transport layer can comprise suitable charge transport compounds, such as, an aryl amine, like N,N'-diphenyl-N,N'-bis(3-methylphenyl)-[1,1'-biphenyl]-4,4'diamine and a polystyrene containing a hindered phenol. Any suitable and conventional techniques may be utilized to apply the charge transport layer coatings solutions such as, for example, spraying, dip coating, extrusion coating, roll coating, wire wound rod coating, draw bar coating, and the like.

Each of the dried charge transport layers possess in embodiments, a thickness of for example, from about 5 to about 500 micrometers and more specifically a thickness of, for example, from about 10 micrometers to about 50 micrometers. In specific embodiments, the total thickness of the two charge transport layers is about 25 micrometers. In general, the ratio of the thickness of the charge transport layer to the charge generating layer is in embodiments, maintained at from about 2:1 to about 200:1, and in some instances about 400:1, and wherein the second or top charge transport layer possesses excellent wear resistance.

The charge generating layer, dual charge transport layers and optional layers may be applied in any suitable order to provide either positive or negative charging photoreceptors. For example, the charge generating layer may be applied prior to the charge transport layer, as illustrated in U.S. Pat. No. 4,265,990. In embodiments, the charge transport layers are employed upon a charge generating layer, and the charge transport layers may optionally be overcoated with an overcoat and/or protective layer.

The photoreceptor substrate may be opaque or substantially transparent, and may comprise any suitable organic or inorganic material having the requisite mechanical properties. The substrate can be formulated entirely of an electrically conductive material, or it can be an insulating material including inorganic or organic polymeric materials, such as MYLAR®, a commercially available polymer, MYLAR® coated titanium, a layer of an organic or inorganic material having a semiconductive surface layer, such as, indium tin oxide, aluminum, titanium, and the like, or exclusively be made up of a conductive material such as, aluminum, chromium, nickel, brass, and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer having an electrically conductive surface. The thickness of the substrate layer depends on numerous factors, including mechanical performance and economic considerations. The thickness of this layer may range from about 65 micrometers to about 3,000 micrometers, and in embodiments, from about 75 micrometers to about 1,000 micrometers for optimum flexibility and minimum induced surface bending stress when cycled around small diameter rollers, for example, 19 millimeter diameter rollers. The surface of the substrate layer is in embodiments, cleaned prior to coating to promote greater adhesion of the deposited coating composition. Cleaning may be effected by, for example, exposing the surface of the substrate layer to plasma discharge, ion bombardment, and the like methods. Similarly, the substrate can be either rigid or flexible. In embodiments, the thickness of this layer is from about 3 millimeters to about 10 millimeters. For flexible belt imaging members, for example, substrate thicknesses are from about 65 to about 150 microns, and in embodiments, from about 75 to about 100 microns for optimum flexibility and minimum stretch when cycled around small diameter rollers of, for example, 19 millimeter diameter. The entire substrate can comprise the same material as that in the electrically conductive surface or the electrically conductive surface can be merely a coating on the substrate. Any suitable electrically conductive material for passing or preventing the passage of holes into and out of the conductive layer can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, indium, tin, metal oxides, including tin oxide and indium tin oxide, and the like.

The conductive layer of the substrate can vary in thickness over substantially wide ranges depending on the desired use of the electrophotoconductive member. Generally, the conductive layer ranges in thickness of from about 50 Angstroms to about 100 centimeters. When a flexible electrophotographic imaging member is desired, the thickness of the conductive layer typically is from about 20 Angstroms to about 750 Angstroms, and in embodiments, from about 100 to about 200 Angstroms for an excellent combination of electrical conductivity, flexibility, and light transmission.

A hole blocking layer may be applied to the substrate and in contact with the conductive layer, or in contact with the substrate when a conductive layer is absent. Generally, electron blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. Thus, an electron blocking layer is normally not expected to block holes in positively charged photoreceptors such as, photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material of for example, polymers such as, polyvinylbutyral, epoxy resins, polyesters, polysiloxanes, polyamides, polyurethanes, and the like, or may be nitrogen containing siloxanes or nitrogen containing titanium compounds such as, trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl)methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110 and incorporated herein by reference in their entirety. Other suitable charge blocking layer polymer compositions are also described in U.S. Pat. No. 5,244,762, such as, vinyl hydroxyl ester and vinyl hydroxy amide polymers wherein the hydroxyl groups have been partially modified to benzoate and acetate esters that modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597 and incorporated herein by reference in its entirety. An example of such an alkyl acrylamidoglycolate alkyl ether containing polymer is the copolymer poly(methyl acrylamidoglycolate methyl ether-co-2-hydroxyethyl methacrylate). Other blocking layer components may comprise zinc oxide, titanium oxide, silica, polyvinyl butyral, and phenolic resins.

The blocking layer in embodiments, may be continuous and may have a thickness of less than from about 10 micrometers, and more specifically, from about 1 to about 5 micrometers. In embodiments, a blocking layer of from about 0.005 micrometers to about 1.5 micrometers facilitates charge neutralization after the exposure step and optimum electrical performance is achieved. The blocking layer may be applied by any suitable conventional technique such as, spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution, with the solvent being removed after deposition of the coating by conventional techniques such as, by vacuum, heating, and the like. Generally, a weight ratio of blocking layer material and solvent of from about 0.05:100 to about 5:100 is satisfactory for spray coating.

If desired an optional adhesive layer may be formed on the substrate and more specifically between a layer on the substrate and the photogenerating layer. Any suitable adhesive may be used such as, polyesters, polyarylates, polyurethanes, and the like. Any suitable solvent may be used to form an adhesive layer coating solution, such as, tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer can for example, be applied directly to the charge blocking layer. Thus, the adhesive layer is in embodiments, in direct contiguous contact with both the underlying charge blocking layer and the overlying charge generating layer to enhance adhesion bonding and to effect ground plane hole injection suppression. Drying of the deposited coating may be effected by any suitable conventional process such as, oven drying, infrared radiation drying, air drying, and the like. The adhesive layer should be continuous and can be of a thickness of from about 0.01 micrometers to about 2 micrometers after drying. In embodiments, the dried thickness is from about 0.03 micrometers to about 1 micrometer.

The components of the photogenerating layer comprise photogenerating particles of for example, of Type V hydroxygallium phthalocyanine, x-polymorph metal free phthalocyanine, or chlorogallium phthalocyanine photogenerating pigments dispersed in a polymer binder. Type V hydroxygallium phthalocyanine possesses a X-ray powder diffraction (XRPD) peaks at, for example, Bragg angles (2 theta +/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The Diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments, have an average particle size of less than about 5 micrometers.

Photogenerating layer thicknesses of from about 0.05 micrometers to about 100 micrometers can be selected and in embodiments, this layer can be from about 0.05 micrometers to about 40 micrometers thick. The photogenerating binder layer containing photoconductive compositions and/or pigments, and the resinous binder material in embodiments, ranges in thickness of from about 0.1 micrometers to about 5.0 micrometers, and in embodiments, has a thickness of from about 0.3 micrometers to about 3 micrometers for improved light absorption and improved dark decay stability and mechanical properties.

For example, from about 10 percent by volume to about 95 percent by volume of the photogenerating pigment may be dispersed in from about 40 percent by volume to about 60 percent by volume of the film forming polymer binder composition, and in embodiments, from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and in embodiments, from about 25 to about 75 percent by weight, and the binder is present in an amount of from about 20 to about 95 percent by weight, and in embodiments, from about 25 to about 75 percent by weight, although the relative amounts can be outside these ranges. The photogenerating layer containing photoconductive compositions and the resinous binder material generally ranges in thickness from about 0.05 microns to about 10 microns or more, and in embodiments, from about 0.1 microns to about 5 microns, and in more specific embodiments having a thickness of from about 0.3 microns to about 3 microns, although the thickness may be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide the photogenerating layer in a thickness sufficient to absorb about 90 percent or more of the incident radiation which is directed upon it in the imagewise or printing exposure step. The maximum thickness of this layer is dependent primarily upon factors such as, mechanical considerations, the specific photogenerating compound selected, the thicknesses of the other layers, and whether a flexible photoconductive imaging member is desired. The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as, oven drying, infrared radiation drying, air drying, and the like.

Any suitable film forming binder may be utilized in the photoconductive or photogenerating layer. Examples of suitable binders for the photoconductive materials include thermoplastic and thermosetting resins such as, polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Specific inactive binders include polycarbonate resins with a weight average molecular weight of from about 20,000 to about 100,000. In embodiments, a weight average molecular weight of from about 50,000 to about 100,000 is specifically selected. More specifically, excellent imaging results are achieved with poly(4,4'-diphenyl-1,1'-cyclohexane carbonate)polycarbonate; poly(4,4'-diphenyl-1,1'-cyclohexane carbonate-500, with a weight average molecular weight of 51,000; or poly(4,4'-diphenyl-1,1'-cyclohexane carbonate-400, with a weight average molecular weight of 40,000.

The charge transport layers are normally transparent in a wavelength region in which the electrophotographic imaging member is to be used when exposure is effected therethrough to ensure that most of the incident radiation is utilized by the underlying charge generating layer. The charge transport layer should exhibit negligible charge generation, and discharge if any, when exposed to a wavelength of light useful in xerography, e.g., 4000 to 9000 Angstroms. When used with a transparent substrate, imagewise exposure or erase may be accomplished through the substrate with all light passing through the substrate. In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. The charge transport layer should trap minimal charges either holes or electrons as the case may be passing through it.

In a specific embodiment, the first charge transport layer comprises N,N'-diphenyl-N,N'-bis(3-methylphenyl)-[1,1'-biphenyl]-4,4'diamine in a polycarbonate binder, followed by a second charge transport layer of N,N'-diphenyl-N,N'-bis(3-methylphenyl)-[1,1'-biphenyl]-4,4'diamine, and octadecyl-3,5-di-tert-butyl-4-hydroxyhydro ciannamate (IRGANOX-1010) containing polystyrene.

Optionally, an overcoat layer and/or a protective layer can also be utilized to improve resistance of the photoreceptor to abrasion. In some cases, an anticurl back coating may be applied to the surface of the substrate opposite to that bearing the photoconductive layer to provide flatness and/or abrasion resistance where a web configuration photoreceptor is fabricated. These overcoating and anticurl back coating layers can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semi-conductive matrices. The use of such an overcoat can still further increase the wear life of the photoreceptor.

COMPARATIVE EXAMPLE

Layered devices were generated by hand coating two separate transport layers on charge generation layers of hydroxy gallium phthalocyanine in an amount of about 35 weight percent in a polymer of poly(4,4'-diphenyl-1,1'-cyclohexane carbonate), present in an amount of about 65 weight percent. The imaging device contained two charge transport layers with no hindered phenol attached to a styrene polymer. A twenty-five micrometer thick transport layer was fabricated by dispersing 40 percent by weight N,N'-diphenyl-N,N'-bis(3-methylphenyl)-[1,1'-biphenyl]-4,4'diamine in a polycarbonate resin in an amount of about 60 weight percent and having a weight average molecular weight of from about 50,000 to about 100,000 to form a first charge transport layer and then depositing on the first charge transport layer 40 percent by weight of N,N'-diphenyl-N,N'-bis(3-methylphenyl)-[1,1'-biphenyl]-4,4'diamine in about 60 weight percent of the binder poly(4,4'-diphenyl-1,1'-cyclohexane carbonate) to form a second charge transport layer of about 5 micrometers thick. Results indicate the migration of phenols into the charge generating layer, detrimentally altering the pigment response (cycle-up).

Example I

To a 250 milliliter three-necked flask attached to a condenser, a Dean-stark trap, an inert gas inlet tube and a magnetic stir bar, 4.4 grams of poly(styrene-co-allyl alcohol) was mixed with 5.7 grams of 3-[4-hydroxyl-3,5-di-tert-butylphenyl]propionic acid and 70 milliliters toluene. Upon heating to about 120 degrees Celsius, with stirring, the solid disappeared slowly. To the resulting yellowish solution, 1 milliliter of concentrated sulfuric acid was added. The solution turned brown immediately. Under argon gas flow, the reaction mixture was refluxed at about 120 degrees Celsius for 18 hours. The reaction was stopped by cooling to room temperature. Then the resulting solution was poured into 100 milliliters of methanol with strong stirring. The slight-brown precipitate was collected by filtration, and washed in 100 milliliters of deionized water and 3×30 milliliter methanol continuously. The final product was poly(styrene-co-allyl alcohol-g-3,5-di-tert-butyl-4-hydroxyhydrociannamate) having a weight average molecular weight of about 5,700 and a number average molecular weight of about 4,780 was dried in a vacuum oven at 70 degrees Celsius.

Layered devices were generated by hand coating two separate transport layers on charge generation layers of hydroxy gallium phthalocyanine in an amount of about 35 weight percent in a polymer of poly(4,4'-diphenyl-1,1'-cyclohexane carbonate), present in an amount of about 65 weight percent. A twenty-five micrometer thick transport layers was fabricated by dispersing 40 percent by weight N,N'-diphenyl-N,N'-bis(3-methylphenyl)-[1,1'-biphenyl]-4,4'diamine in a polycarbonate resin having a weight average molecular weight of from about 50,000 to about 100,000 to form a first charge transport layer and then depositing on the first charge transport layer 40 percent by weight N,N'-diphenyl-N,N'-bis(3-methylphenyl)-[1,1'-biphenyl]-4,4'diamine in poly(styrene-co-allyl alcohol-g-3,5-di-tert-butyl-4-hydroxyhydrociannamate) employing methylene chloride solvent to form the second charge transport layer of about five micrometers thick. The device was oven dried at 80 degrees Celsius for 30 minutes and scanned in a drum scanner.

Results indicate that no lateral migration of the charge image pattern occurs with the hindered phenol attached to a polymer in the second charge transport layer. The device was scanned for positive charge acceptance and the center portion of the device was exposed to corotron effluents and the device scanned again for positive charge acceptance.

Although the invention has been described with reference to specific embodiments, it is not intended to be limited thereto. Rather, those having ordinary skill in the art will recognize that variations and modifications, including equivalents, substantial equivalents, similar equivalents, and the like may be made therein which are within the spirit of the invention and within the scope of the claims.

What is claimed is:

1. An imaging member comprising:

a photogenerating layer, (1) a first charge transport layer comprised of a charge transport component and a resin binder, and thereover and in contact with the first layer (2) a second top charge transport layer comprised of a charge transport component, a resin binder and a polymer of a styrene containing hindered phenol, wherein said resin binder in said second charge transport layer is not a polymer of a styrene containing hindered phenol.

2. An imaging member according to claim 1 wherein said hindered phenol in said polymer of the second charge transport layer is selected from the group consisting of octadecyl 3,5-di-tert-butyl-4-hydroxyhydrocinnamate, Thiodiethylene bis-(3,5-di-tert-butyl-4-hydroxy) hydrocinnamate, o,o-di-n-octadecyl-3,5-di-tert-butyl-4-hydroxybenzyl phosphonate, N,N'-hexamethylene bis-(3,5-di-tert-butyl-4-hydroxyhydrocinnamamide), and 1,3,5-tris (3,5-di-tert-butyl-4-hydroxybenzyl)-1,3,5-triazine-2,4,6 (1H,3H,5H)-trione.

3. An imaging member according to claim 1 wherein said hindered phenol in said polymer of the second charge transport layer comprises octadecyl-3,5-di-tert-butyl-4-hydroxyhydrocinnamate.

4. An imaging member according to claim 1 wherein said first charge transport layer has a thickness of from about 10 to about 50 micrometers and said second charge transport layer has a thickness of about 1 to 25 micrometers.

5. An imaging member according to claim 1 wherein said first charge transport layer has a thickness of from about 20 to about 30 micrometers and said second charge transport layer has a thickness of from about 3 to about 7 micrometers.

6. An imaging member according to claim 1 wherein said hindered phenol in said polymer of said second charge transport layer is octadecyl 3,5-di-tert-butyl-4-hydroxyhydrocinnamate and is present in an amount of from about 2 percent to about 10 percent by weight.

7. An imaging member according to claim 1 wherein each of said first and second charge transport layers comprise said resin binder in an amount of from about 20 to about 80 percent by weight.

8. An imaging member according to claim 1 wherein said first charge transport layer comprises N,N'-diphenyl-N,N'-bis(3-methylphenyl)-[1,1'-biphenyl]-4,4'diamine in an amount of about 40 percent by weight and poly(4,4'-diphenyl-1,1'-cyclohexane carbonate) in an amount of about 60 percent by weight.

9. An imaging member according to claim 1 wherein said second charge transport layer comprises N,N'-diphenyl-N,N'-bis(3-methylphenyl)-[1,1'-biphenyl]-4,4'diamine in an amount of about 35 weight percent and poly (4,4'-diphenyl-1,1'-cyclohexane carbonate) in an amount of about 35 percent by weight, and said polymer of styrene containing hindered phenol of a styrene/octadecyl-3,5-ditert-butyl-4-hydroxyhydrocinnamate is present in an amount of about 30 percent by weight.

10. The imaging member according to claim 9 further comprising a hole blocking layer, an adhesive layer and an overcoat layer.

11. An imaging member according to claim 1 further comprising an adhesive layer and an overcoat layer.

12. An imaging member according to claim 1 wherein polymer of a styrene containing hindered phenol of said second charge transport layer comprises poly(styrene-co-allyl alcohol-g-3,5-di-tert-butyl-4-hydroxyhydrocinnamate).

13. An imaging member according to claim 1 wherein the weight average molecular weight of the polymer of a styrene containing hindered phenol of said second charge transport layer is from about 3,500 to about 10,000.

14. A process comprising:

providing an imaging member in accordance with claim 1 wherein said charge transport layers are coated in two passes.

15. An imaging member according to claim 1 wherein said imaging member further comprises a charge blocking layer comprised of zinc oxide, titanium oxide, silica, polyvinyl butyral, and phenolic resins.

16. An imaging member according to claim 1 wherein said imaging member further comprises a charge blocking layer having a thickness of from about 2 micrometers to about 10 micrometers.

17. An imaging member according to claim 1 wherein said imaging member further comprises a charge blocking layer having a thickness of from about 2 micrometers to about 4 micrometers and comprising polyvinylbutyral, titanium oxide, or silica.

18. An imaging member according to claim 1 wherein said photogenerating layer has a thickness of from about 75 to about 1,000 micrometers.

19. An imaging member according to claim 1 wherein said photogenerating layer comprises Type V hydroxygallium phthalocyanine, chlorogallium phthalocyanine, x-polymorph metal-free phthalocyanine, or vinyl chloride.

20. An imaging member according to claim 1 wherein said charge generating layer comprises hydroxygallium phthalocyanine and a polycarbonate binder.

21. An imaging member according to claim 1, further comprising a supporting substrate.

22. An imaging member according to claim 21 wherein said substrate has a thickness of from about 50 micrometers to about 1,000 micrometers.

23. An imaging member according to claim 21 wherein said substrate has a thickness of from about 80 to about 120 micrometers.

24. An imaging member according to claim 1, wherein said resin binder of said second change transport layer is a polycarbonate binder.

25. An image forming device comprising at least a photoreceptor and a charging device which charges the photoreceptor, wherein the photoreceptor comprises:

a photogenerating layer, (1) a first charge transport layer comprised of a charge transport component and a resin binder, and thereover and in contact with the first layer (2) a second top charge transport layer comprised of a charge transport component, a resin binder and a polymer of a styrene containing hindered phenol, wherein said resin binder in said second charge transport layer is not a polymer of a styrene containing hindered phenol.

26. An device according to claim 25 wherein the charge transport layers are coated in two passes.

27. The image forming device according to claim 25 wherein the photoreceptor is in the form of a belt.

28. The image forming device according to claim 25 wherein the photoreceptor is in the form of a drum.

29. An image forming device according to claim 25, wherein said resin binder of said second change transport layer is a polycarbonate binder.

30. An imaging member comprising:

a photogenerating layer, (1) a first charge transport layer comprised of N,N'-diphenyl-N,N'-bis(3-methylphenyl)-[1,1'-biphenyl]-4,4'diamine in an amount of about 40 percent by weight and poly(4,4'-diphenyl-1,1'-cyclohexane carbonate) in an amount of about 60 percent by weight, and thereover and in contact with the first layer (2) a second top charge transport layer comprised of N,N'-diphenyl-N,N'-bis(3-methylphenyl)-[1,1'-biphenyl]-4,4'diamine in an amount of about 35 weight percent and poly(4,4'-diphenyl-1,1'-cyclohexane carbonate) in an amount of about 35 percent by weight, and a polymer of styrene containing hindered phenol of a styrene/octadecyl-3,5-ditert-butyl-4-hydroxyhydrocinnamate is present in an amount of about 30 percent by weight.

31. An imaging member comprising:

a photogenerating layer, (1) a first charge transport layer comprised of a charge transport component and a resin binder, and thereover and in contact with the first layer (2) a second top charge transport layer comprised of a charge transport component and a polymer of a styrene containing hindered phenol, wherein said polymer of styrene is represented by:

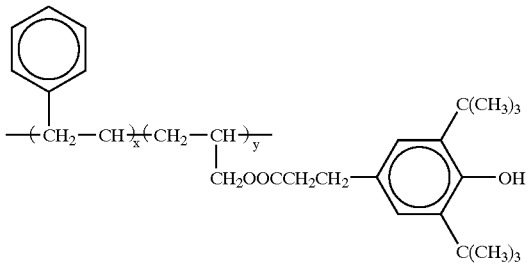

wherein x and y represent the number of segments.

* * * * *